US009161576B2

(12) United States Patent
Furfaro

(10) Patent No.: US 9,161,576 B2
(45) Date of Patent: Oct. 20, 2015

(54) BOTTOM LINING FOR CYCLIST SHORTS OR SUIT AND PROCESS OF MAKING SAME

(75) Inventor: Demis Furfaro, Villafranca (IT)

(73) Assignee: T.M.F.S.N.C. DITURRINI PATRIZIA & C, Villafranca (Verona) (IT)

( * ) Notice: Subject to any disclaimer, the term of this patent is extended or adjusted under 35 U.S.C. 154(b) by 0 days.

(21) Appl. No.: 13/138,120

(22) PCT Filed: Jan. 15, 2010

(86) PCT No.: PCT/EP2010/000188
§ 371 (c)(1),
(2), (4) Date: Jul. 8, 2011

(87) PCT Pub. No.: WO2010/081706
PCT Pub. Date: Jul. 22, 2010

(65) Prior Publication Data

US 2011/0271425 A1 Nov. 10, 2011

(30) Foreign Application Priority Data

Jan. 15, 2009 (IT) ..... MO2009A0007

(51) Int. Cl.
*A41D 13/00* (2006.01)
*A41D 1/08* (2006.01)

(52) U.S. Cl.
CPC ..... *A41D 1/084* (2013.01); *A41D 1/088* (2013.01); *A41D 2600/104* (2013.01)

(58) Field of Classification Search
CPC .. A41D 2600/104; A41D 1/084; A41D 1/088
USPC ..... 2/467, 401, 272, 227, 214, 466
See application file for complete search history.

(56) References Cited

U.S. PATENT DOCUMENTS

| | | | | | |
|---|---|---|---|---|---|
| 4,805,243 | A * | 2/1989 | Gibbens et al. | 2/228 |
| 4,945,571 | A * | 8/1990 | Calvert | 2/467 |
| 4,961,233 | A * | 10/1990 | Black | 2/228 |
| 5,038,408 | A * | 8/1991 | DeBaene | 2/23 |
| 5,068,920 | A * | 12/1991 | Bray | 2/456 |
| 5,271,101 | A * | 12/1993 | Speth et al. | 2/228 |
| 5,423,087 | A * | 6/1995 | Krent et al. | 2/463 |
| D360,971 | S * | 8/1995 | Speth et al. | D2/705 |
| 5,978,970 | A * | 11/1999 | Bright | 2/267 |
| 6,029,281 | A * | 2/2000 | Battley | 2/406 |
| 6,565,702 | B1 * | 5/2003 | Forsyth et al. | 156/308.4 |
| 6,618,860 | B1 * | 9/2003 | Sullivan et al. | 2/159 |
| 6,687,917 | B2 * | 2/2004 | Forsyth et al. | 2/228 |
| D503,514 | S * | 4/2005 | Yates | D2/738 |
| 6,918,140 | B1 * | 7/2005 | Cooper | 2/228 |

(Continued)

FOREIGN PATENT DOCUMENTS

| | | |
|---|---|---|
| DE | 202 11 311 01 | 12/2003 |
| WO | WO 91/19431 A | 12/1991 |
| WO | WO 2006/023007 A | 3/2006 |

*Primary Examiner* — Richale Quinn
(74) *Attorney, Agent, or Firm* — John Alumit

(57) ABSTRACT

The present invention refers to the field of cyclist sports shorts. More precisely, it refers to a reinforcement bottom lining to be applied inside the shorts crotch. The bottom lining, between two synthetic fabric layers, includes a padding having modulated levels by means of foams and sponges having a gradual pattern for avoiding the presence of steps at abutment and/or rubbing points between body and saddle. Further, the invention provides a process of detecting the body pressure points against the saddle by an impression, that is by the detection of body/saddle casts.

2 Claims, 3 Drawing Sheets

(56) References Cited

U.S. PATENT DOCUMENTS

| | | | | |
|---|---|---|---|---|
| 6,928,665 | B1 * | 8/2005 | Yates | 2/466 |
| 6,990,693 | B2 * | 1/2006 | Reschewitz | 2/228 |
| 7,430,766 | B2 * | 10/2008 | Coccia | 2/228 |
| 7,707,659 | B2 * | 5/2010 | Africa et al. | 2/267 |
| 7,739,754 | B2 * | 6/2010 | Garneau | 2/466 |
| 7,757,311 | B2 * | 7/2010 | Garneau | 2/466 |
| 8,087,097 | B2 * | 1/2012 | Maier | 2/227 |
| 8,230,520 | B2 * | 7/2012 | Riondato | 2/79 |
| 2003/0131399 | A1 | 7/2003 | Forsyth et al. | |
| 2007/0226889 | A1 | 10/2007 | Pesta | |
| 2010/0095442 | A1 * | 4/2010 | Kuipers | 2/466 |

* cited by examiner

PRIOR
ART

BOTTOM LINING FOR CYCLIST SHORTS OR SUIT AND PROCESS OF MAKING SAME

The object of the present invention refers to a reinforcement lining bottom to be applied to cyclist shorts or suits and also to a process of making the same.

Specifically, the bottom lining is designed for the human body anatomy.

As it is known, bottom linings are formed by moulding synthetic fabric layers incorporating a synthetic open-cell foam layer having varying densities according to the pressure exerted by the mould.

Bottom linings have a front (prostatic) zone and a rear (sacral) zone which both abut the saddle. Therefore, bottom linings are the interface between the saddle shape and cyclist anatomy.

The prior art provides the insertion, in the points of higher supports, of paddings located between two synthetic fabric layers, for example, a jersey-type mesh fabric and a foam (sponge) fabric having a density of 30 kg/m3 and thickness of 3 mm.

The composite is pressed by a mould to form inner zones of higher thickness and outer zones of lower thickness and therefore of higher density.

From a zone to another, there are steps at the abutment points of body against the saddle, eventually causing the rubbing of body at each abutment points, of lowest and highest friction.

Further, in order to help the adherence of the bottom lining to saddle, the prior art provides the development of a wrapping effect by means of two systems having drawbacks.

The first system provides the steps of cutting the bottom lining in two parts along the longitudinal axis of the bottom lining and joining the two parts by a strong stitch forming a ridge that can irritate the human body especially during long runs.

Another solution provides the formation of a weakening line along the bottom lining longitudinal axis during the moulding step; which also forms a ridge causing the same above mentioned drawbacks.

The object of the present invention is to eliminate the above cited drawbacks, particularly to avoid the steps formed in the transition points from a thickness to another of the padding.

The advantages obtained by the present invention are:

- A better comfort particularly during long runs because the product of the present invention takes into consideration the abutment, pressure and friction points between body and saddle and naturally adapts to body movements and avoids any rubbing against the saddle.
- Better wearability due to the different types and thicknesses of foams according to the abutment, pressure and friction points between body and saddle.

Said aims and advantages are all met by a reinforcement bottom lining to be applied to cyclist shorts or suits, object of the present invention, characterized by the following claims.

Moreover, the present invention is characterized by a process of making the bottom lining.

This and other features will be better highlighted by the following description of some embodiments shown merely as a non limiting example in the attached drawings, wherein.

Figure 2:
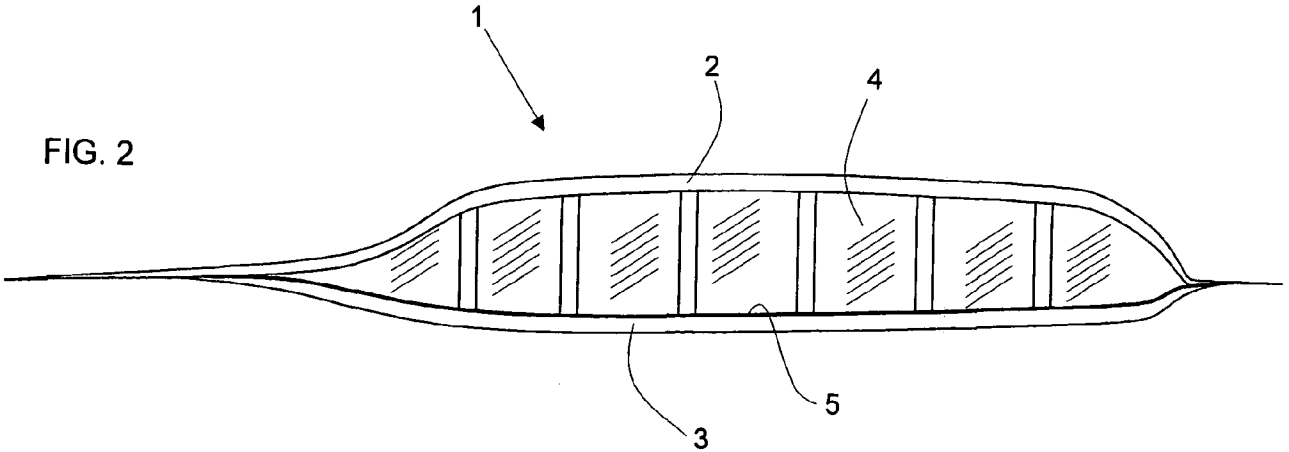
FIGS. 2, 4 and 6 illustrate a cross-section and a plan view respectively of the bottom lining of the present invention.
Figure 3:
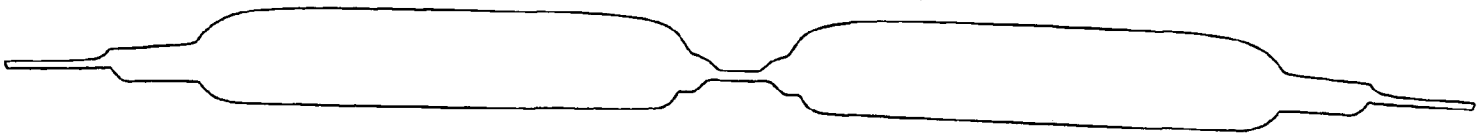
FIG. 3 PRIOR ART
Figure 4:
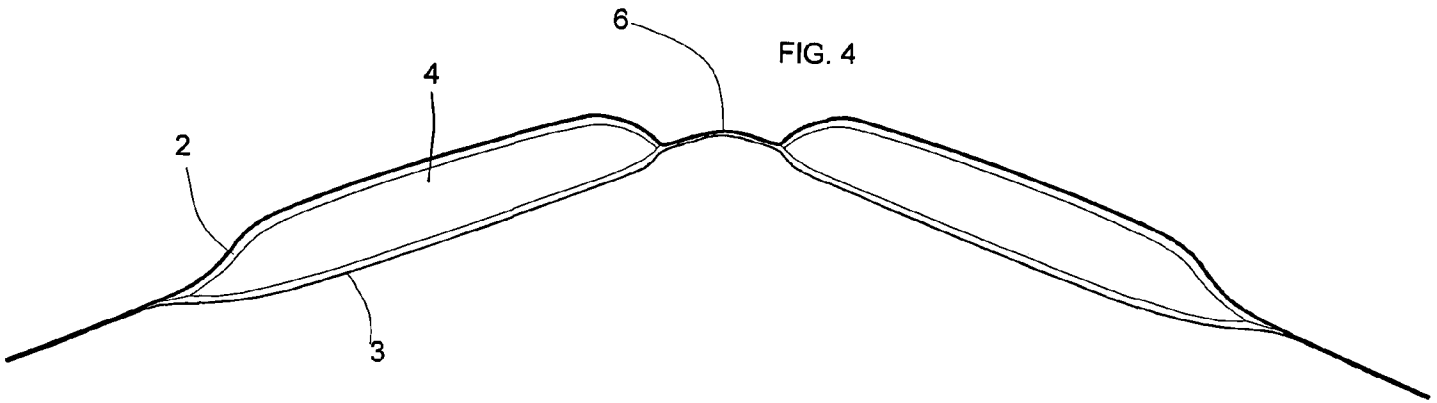
Figure 6:
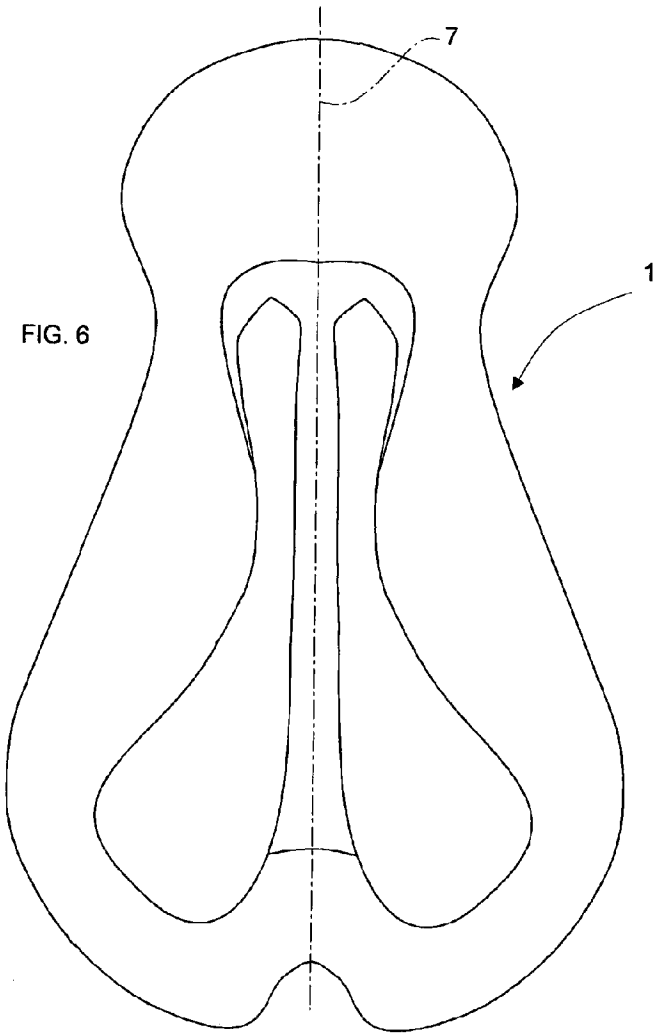
Figure 5:
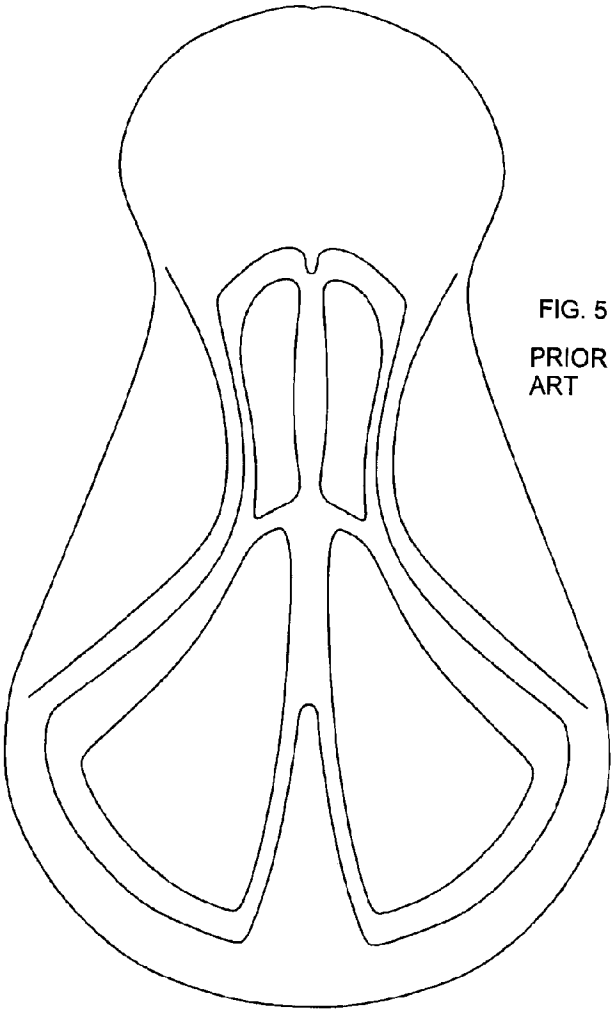

Referring particularly to FIGS. 2, 4 and 6, it can be seen the bottom lining generally indicated with 1 comprises two layers 2 and 3 made of synthetic fabric, between them there are two layers 4 and 5 respectively of sponge or foam, more specifically the thicker layer 4 is formed by a foam of high density, for example, of 80 kg/m$^3$ having a thickness of 8 mm. Said layer 4 has a cross-section that gradually decreases outwardly, with one side forming a bend 6 that connects two identical symmetrical portions of the bottom lining. Said layer 4 has the maximum thickness in the central part of each portion. Layer 5, that in the example shown has a thickness of 3 mm, a density of approximately 60 kg/m$^3$, extends beyond layer 4 and the transition between the two layers is uniformly radiused.

Figure 1:
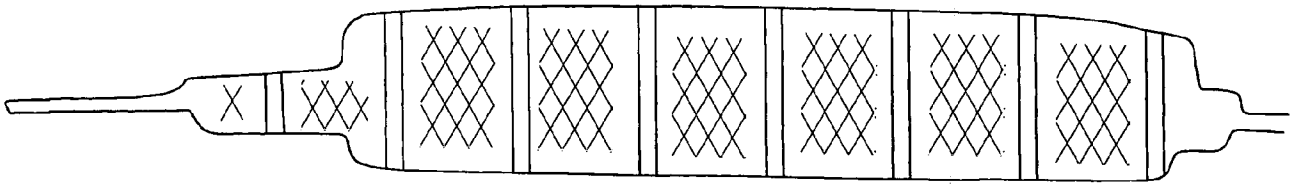
FIG. 1 PRIOR ART
FIGS. 1, 3 and 5 illustrate a cross-section and a plan view respectively of a known bottom lining, in order to better show the differences from the bottom lining of the present invention.

As noted, unlike FIG. 1, there are no spaces in each zones of the bottom lining and particularly where the bottom lining contacts the human body.

Corners have been eliminated also in zones where the leg moves; zones where the maximum friction of the body against the saddle occurs when pushing on pedal.

As highlighted in FIG. 4, during the bottom moulding step, a bend 6 is formed along the bottom longitudinal axis 7, developing the saddle wrapping effect is created that, according to the prior art, could be obtained only by cut-and-stitch or a weakening line along said axis.

For making the bottom lining and said foam inserts having a gradual pattern, the process provides an impression for making the bottom lining.

Actually, the values of pressure and abutment points have been evaluated and studied by means of casts of the body/saddle.

Casts have been manufactured for different type of persons in order to envisage a shape having a perfect conformability between body and saddle and develop a padding having modulated levels at support points by means of foams having a gradual pattern.

The gradual foam, besides being shaped, has, as shown in the attached example, two inner layers: a first high density layer having a thickness of 8 mm and another layer of density as high as 60 kg/m$^3$ having a thickness of 3 mm; these values being referred as a simple example of an embodiment, however they can change according to the type of foams used.

The values of foams densities and their thicknesses can vary as desired, while keeping true what is claimed in the following claims.

What is claimed:

1. A reinforced bottom lining to be applied to cyclist shorts or suits, consisting of:

- two synthetic fabric layers, a padding layer disposed between the two synthetic fabric layers;
- a padding layer consisting of a first layer and a second layer of foam;
- wherein the first layer is formed by a foam having a density of 80 kg/m$^3$ density and having a cross-section that has a maximum thickness of 8 millimeters; said first layer gradually decreases in thickness outwardly with one side forming a bend that connects two identical symmetrical portions of the bottom lining; and
- wherein second layer has a density of 60 kg/m$^3$ and extends beyond said first layer in a uniformly radiused manner.

2. The reinforced bottom lining according to claim 1, wherein said bend is molded along a longitudinal axis in order to shape the bottom lining into a saddle.

* * * * *